United States Patent [19]

Lee et al.

[11] Patent Number: 4,548,405

[45] Date of Patent: Oct. 22, 1985

[54] TREADMILL WITH TRAMPOLINE-LIKE SURFACE

[75] Inventors: Robert C. Lee, 4643 Richmond, Houston, Tex. 77027; Larry J. Weigand; Jeffrey O. Merideth, both of Houston, Tex.

[73] Assignee: R. Clayton Lee, Houston, Tex.

[21] Appl. No.: 464,315

[22] Filed: Feb. 7, 1983

[51] Int. Cl.[4] ..... A63B 23/06; A63B 5/18

[52] U.S. Cl. ..... 272/69; 272/65

[58] Field of Search ..... 272/69, 65

[56] References Cited

U.S. PATENT DOCUMENTS

| | | | |
|---|---|---|---|
| 921,755 | 5/1909 | Volk | 272/69 |
| 2,315,485 | 4/1943 | Jones | 272/69 |
| 3,628,654 | 12/1971 | Haracz | 272/69 UX |
| 3,689,066 | 9/1972 | Hagen | 272/69 |

FOREIGN PATENT DOCUMENTS

| | | | |
|---|---|---|---|
| 2503118 | 4/1976 | Fed. Rep. of Germany | 272/69 |

*Primary Examiner*—Robert A. Hafer
*Assistant Examiner*—Arnold W. Kramer
*Attorney, Agent, or Firm*—Pravel, Gambrell, Hewitt & Kimball

[57] ABSTRACT

A treadmill includes an endless belt, the uppermost side of which is adapted to form a flat exercising surface. The endless belt is supported at each end of the exercising surface for supporting and allowing the endless belt to move longitudinally. The edges of the endless belt are also supported by connecting each edge to a support rail through a plurality of springs for providing a trampoline-like effect to the surface.

16 Claims, 8 Drawing Figures

TREADMILL WITH TRAMPOLINE-LIKE SURFACE

BACKGROUND OF THE INVENTION

This invention relates to treadmills and, more particularly, to a treadmill which is formed with a trampoline-like surface that is resilient enough to minimize shock when the foot of an exerciser engages the treadmill surface but rigid enough not to interfere with the normal walking, jogging or running motions.

Treadmills which utilize an endless belt that is adapted so that an individual can walk, jog or run in place are increasing in popularity. This is because such devices are useful not only for exercise purposes, but for rehabilitation programs and medical testing such as the popular "stress test". There is also a demand for treadmills in indoor health clubs since many of them are not able to build a running track and such a treadmill provides the capability of a well rounded exercise program.

Treadmills traditionally are formed so that an endless belt travels over a supporting surface such as a metal plate so that the belt can withstand the weight of individuals using it. The belt in such a design has a tendency to wear because of the frictional contact between the plate and belt. Another possible way of supporting the belt is to provide rollers under the belt which is not totally desirable because the rollers tend to provide an uneven exercise surface.

Exercising on a treadmill with a rigid support surface underneath the belt is similar to exercising on a hard surface because the impact of the feet of the exerciser and the support surface for each step which is taken. This tends to exert undue strain on the legs, which is a common cause of leg problems for joggers and runners and is particularly bothersome for patients which are undergoing a rehabilitation program.

SUMMARY OF THE INVENTION

A treadmill has been developed in accordance with the invention which provides a trampoline-like surface that is designed to eliminate the need for a rigid reinforcing surface underneath the belt. The supporting belt surface is resilient enough to absorb shock so that people can walk, jog or run with less strain on their legs and at the same time rigid enough to provide a stable exercising surface.

The treadmill which embodies the invention includes an endless belt, the uppermost side of which is adapted to form a flat surface capable of supporting an individual. A rotatable roller is located within the endless belt on each end of the supporting surface for supporting and allowing the endless belt continuously to be moved in a longitudinal direction. The belt is supported by a pair of continuous rails that are spaced from and extend along the edges of the endless belt. The edges of the belt are connected to their respective rails through a plurality of coil springs, each of which is connected at one end to the belt and at the other end to a roller assembly which engages one of the rails for supporting the belt and moves around the rail when the belt moves.

The belt can be moved by an electric motor appropriately connected either to one of the rollers or to a shaft for one of the rollers. The endless belt is moved through a friction connection between the driven roller and the inner surface of the belt. The motor can be eliminated and the belt moved solely by the exercising individual or a motor can be connected through a clutch which can be disconnected so the treadmill can be used in its driven or non-driven modes. The support rails are connected to a frame which also holds shafts connected to the rollers. One end of the frame can be raised or lowered for adjusting the angle of the exercising surface.

The portion of the endless belt on which an individual exercises is supported along its outer edges with no supplemental support beneath the belt. The connection between the belt and its supports and the fabric from which the belt is constructed provide the belt with an inherent resiliency that provides a trampoline effect mentioned above. An exercising individual thus does not encounter a solid surface beneath the belt each time he or she takes a step, which reduces strain during exercise.

BRIEF DESCRIPTION OF THE DRAWINGS

A better understanding of the invention can be obtained when the detailed description of a preferred embodiment of the invention set forth below is considered in conjunction with the accompanying drawings, in which.

DETAILED DESCRIPTION OF A PREFERRED EMBODIMENT

Figure 1:
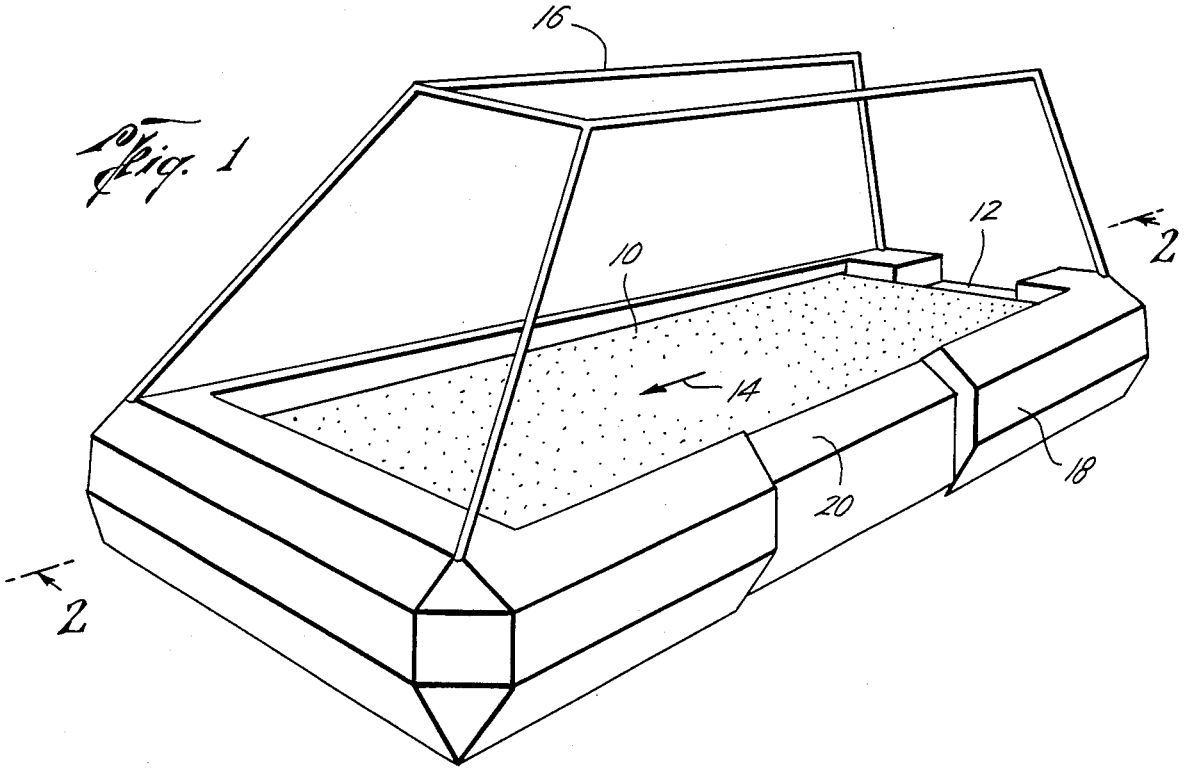
FIG. 1 is a perspective view of a treadmill constructed in accordance with the invention which shows the support surface and a cover which conceals the working components of the treadmill.

FIG. 1 shows the treadmill which is the subject of the instant invention, as it appears to the exerciser. A support surface portion of an endless belt 10 is accessible from the rear of the machine over a step 12, the endless belt 10 moving in the direction of an arrow designated by a reference numeral 14. Guard rails 16 are provided to be grasped by the exerciser so he can maintain his balance. A stylish cover 18 formed of a suitable thermoplastic material is connected to a support frame described below and provided for aesthetic purposes as well as preventing dust and other foreign objects from collecting on internal parts of the machine. A control panel 20 is easily accessible to the exerciser and can include, for example, control buttons (not shown) for regulating belt speed, duration of motion, angle of inclination of the support surface and indicators (not shown) such as a speedometer and an odometer.

Figure 2:
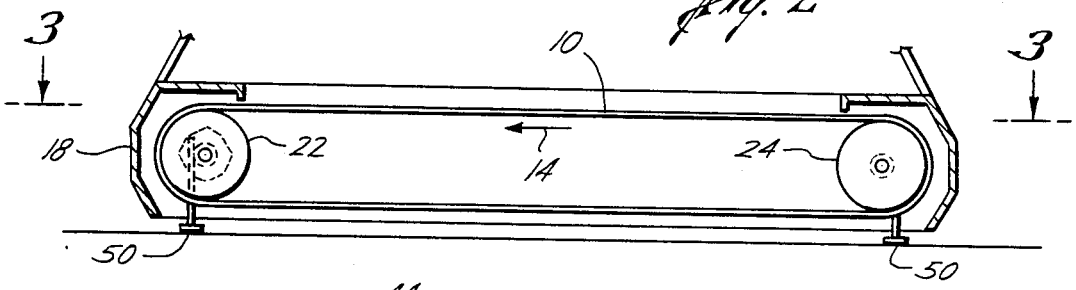
FIG. 2 is a sectional view of the treadmill of FIG. 1 taken along a section line shown in FIG. 1 looking in the direction of arrows 2—2.

As shown in FIG. 2, the endless belt 10 is mounted on a pair of rollers 22, 24, one of which can be driven by an electric motor (not shown) for moving the endless belt 10. The other roller is an idler which rotates as the endless belt 10 moves. The endless belt 10 is formed preferably of a woven, nylon mesh that is slightly elastic. The rollers 22, 24 can be coated with rubber to enhance frictional contact between the rollers and the belt which can be coated with rubber on its inner surface so that the belt can be driven through rotational movement of one of the rollers and be prevented from shifting laterally.

Figure 4:
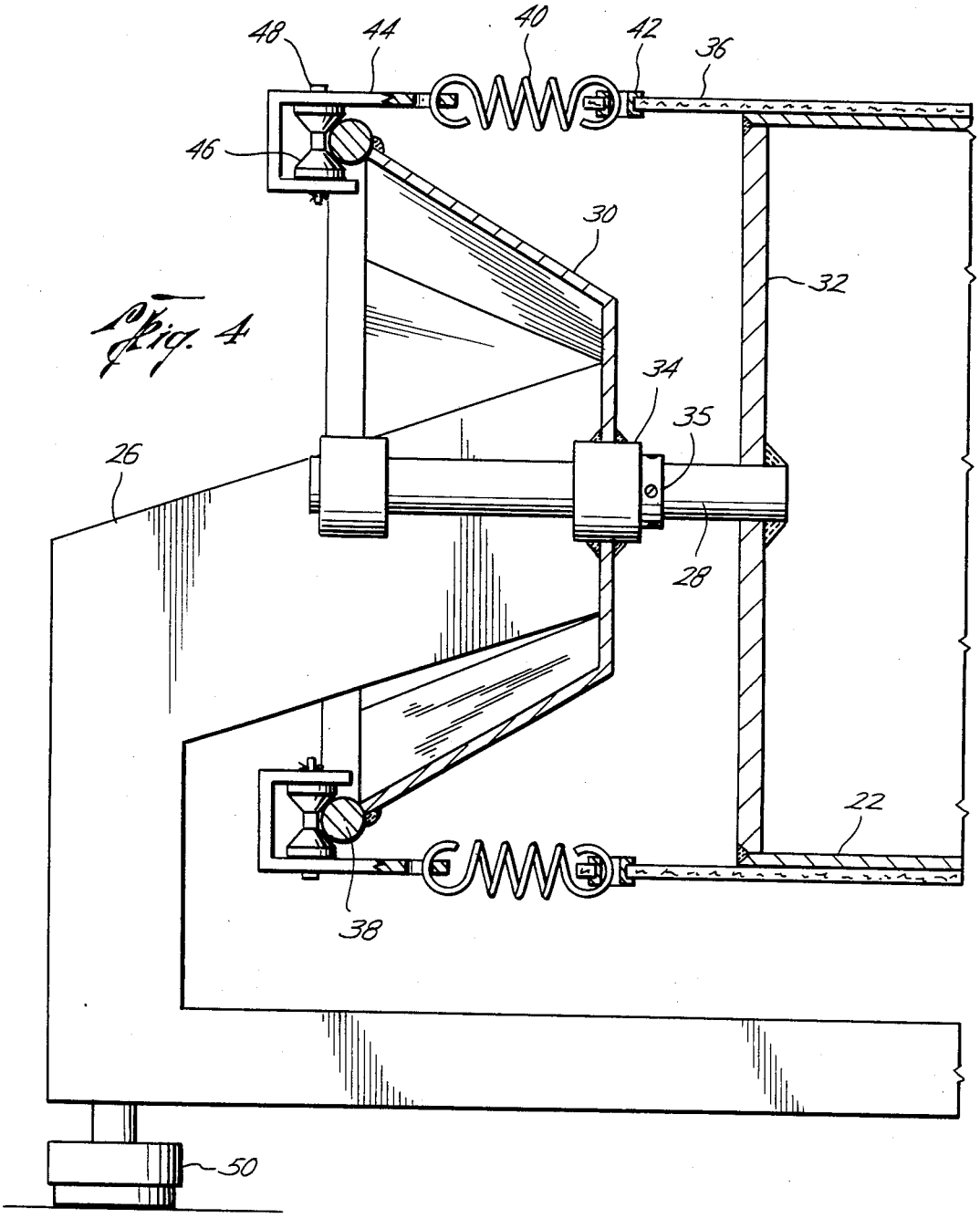
FIG. 4 is a partial section view which shows in particular the support structure and the connection between the support structure and the endless belt, this view being taken along a section line shown in FIG. 3 looking in the direction of arrows 4—4.

As shown best in FIG. 4, the rollers 22, 24 are mounted on a main support frame 26 through shafts 28 which are journaled in a pan member 30 which is connected to the frame 26. The shafts 28 can be welded to end plates 32 of the rollers 22, 24 and bearings 34 can be welded to the pan 30. Couplings 35, connected to the shafts 28 by appropriate set screws, operate to prevent the rollers 22, 24 from shifting laterally.

The endless belt 10 is driven by rotating one of the rollers 22, 24. This driving motion can be supplied by an electric motor (not shown) which is preferably connected to the shaft 28 located at the front left hand side of the machine looking in the direction of arrow 14. The connection between the motor (not shown) and the shaft 28 can be through a conventional gear or chain drive. Alternatively, the motor can be mounted inside one of the rollers 22, 24 on a shaft 28 which is made stationary. In this embodiment, the driven roller is rotatable relative to the shaft. Conventional electrical connections (not shown) can be provided between controls on the panel 20 and the motor.

A conventional clutch mechanism (not shown) can also be provided in conjunction with the motor so that the motor can be disengaged and the support surface moved solely by the action of the exerciser on the belt 10. In this respect, the treadmill which is the subject of the instant invention can be fabricated without any type of driving mechanism for the avid runner who would prefer to be able to run in place at his own speed instead of on a powered support surface.

As shown best in FIG. 2, it will be noticed that there is nothing supporting the belt 10 beneath the exercising surface. Instead, the belt 10 is supported along both edges 36, as shown best in FIGS. 3 and 4. Each edge 36 is connected to a support rail 38 which is spaced from and extends substantially along the edge 36 and is welded or otherwise appropriately connected to the pan 30. A plurality of coil springs 40 are each connected at one end to an edge 36 through a reinforcing grommet 42 formed of brass or the like and at the other end to a roller assembly 43 which is slidably connected to the support rail 38.

Figure 5:
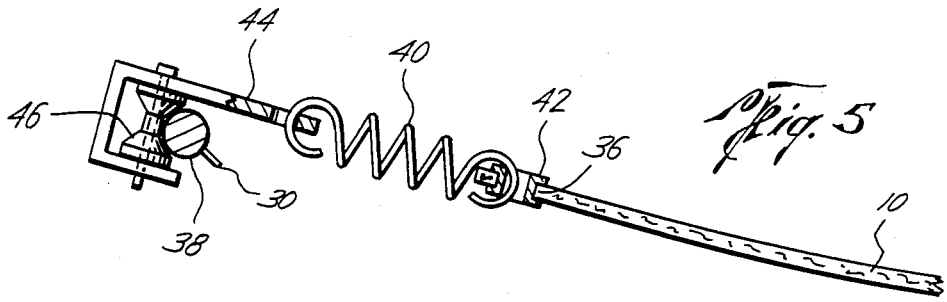
FIG. 5 is a schematic view of the first embodiment of the roller assembly connection between the endless belt and the support structure which illustrates in particular the orientation of the connection and belt while an individual is exercising on the treadmill.
Figure 6:
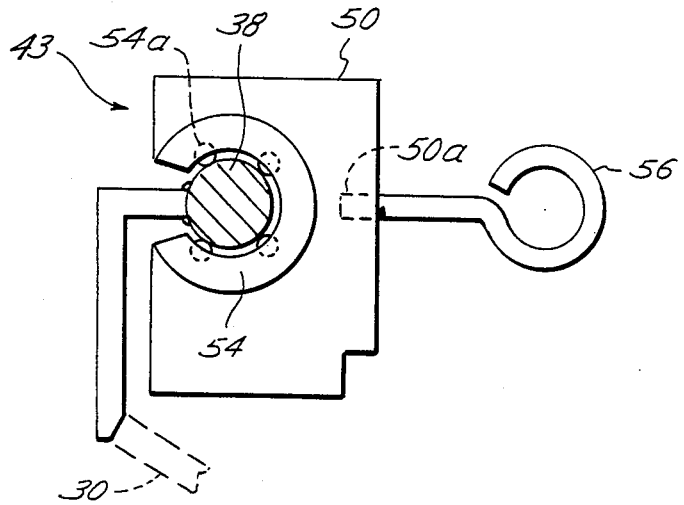
FIG. 6 is a schematic view of the second embodiment of the roller assembly for connecting the endless belt with the support structure.

As seen in FIGS. 4 and 5, a first embodiment of the roller assembly 43 comprises a bracket 44 which is connected to support rail 38 through a self-aligning, hourglass-shaped roller 46 rotatably mounted on bracket 44 through a pin 48. A second embodiment of the roller assembly 43 is shown in FIG. 6. The second embodiment of roller assembly 43 comprises a housing 50 having a longitudinal cavity 52. The longitudinal cavity 52 is a predetermined diameter larger than support rail 38 and has securely mounted interior thereto a bearing sleeve 54 having a plurality of ball bearings **54*a* rotatably mounted within sleeve 54. Ball bearings 54*a* extend a predetermined distance into cavity 52 so as to slidably engage support rail 38 and reduce the sliding friction between roller assembly 43 and support rail 38. A connecting arm 56 threadably engages a threaded bore 50*a* of housing 50 to securely connect housing 50 with spring 40**.

Figure 7:
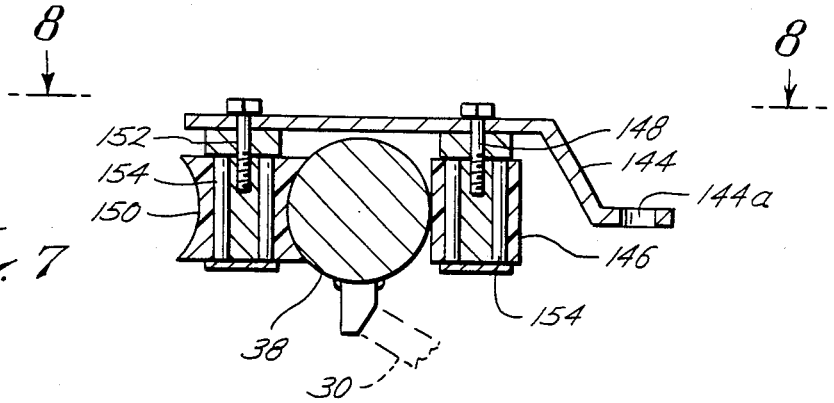
FIG. 7 is a partial section view which shows a third embodiment of the roller assembly for connecting the endless belt with the support structure.
Figure 8:
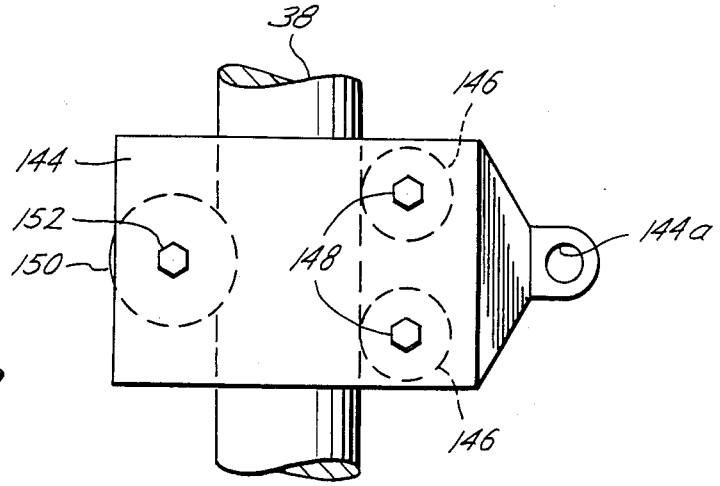
FIG. 8 is a top view of the third embodiment of the roller assembly looking in the direction of arrows 8—8 in FIG. 7.

In a third embodiment of the roller assembly 43 shown in FIGS. 7 and 8, the roller assembly 43 includes a bracket 144, a pair of rollers 146 each rotatably mounted on bracket 144 through a pin 148 and a self-aligning hourglass shaped roller 150 rotatably mounted on the bracket 144 through a pin 152. Rollers 146 are a spaced distance from roller 150 such that rollers 146 are tangent with support rail 38 and roller 150 just rotatably engages support rail 38. To reduce the rolling friction between roller assembly 43 and support rail 38, needle bearings 154 are axially disposed between rollers 150, 146 and support pins 152, 148. Bracket 144 has an opening **144*a* for connecting the roller assembly 43 with spring 40**.

Figure 3:
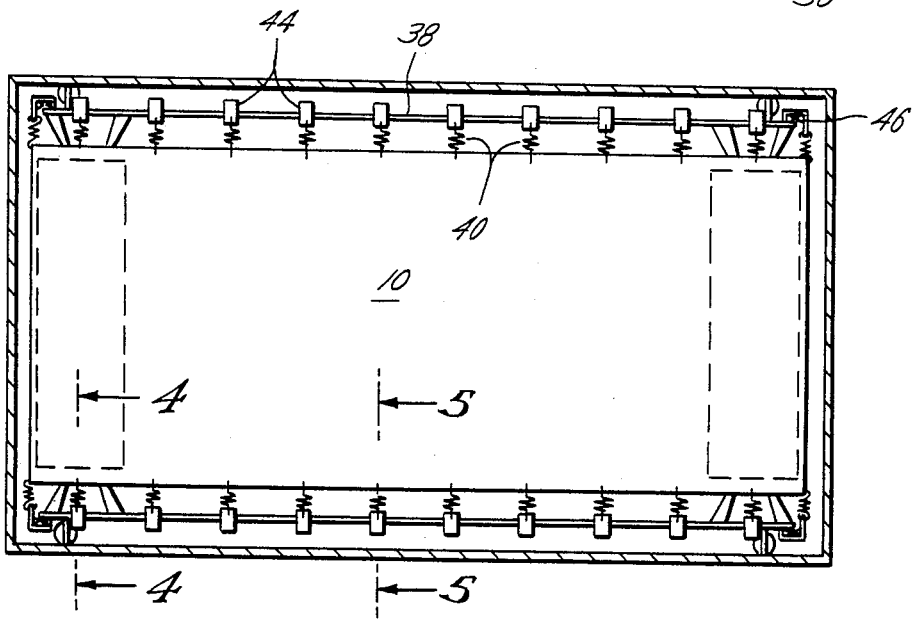
FIG. 3 is a top plan view of the support surface portion of the endless belt, which shows in particular the means for connecting the endless belt to support rails located along each edge of the endless belt, this view being taken along a section line shown in FIG. 2 looking in the direction of arrows 3—3.

The springs 40 are preferably 25–50 pound test coil springs approximately 3" long and, as shown best in FIG. 3, the springs 40 are spaced apart along each edge 36 of the endless belt, preferably at intervals of about 3½"–7".

The support rails 38 are preferably formed of continuous steel rod about 1½" diameter and the hourglass shaped rollers 44, 150 and rollers 46 can either be formed of stainless steel, nylon or other appropriate material. The rollers 22, 24 are steel cylinders about 8 inches in diameter which are coated with rubber. The woven nylon endless belt can have a rubber coating on its inside surface to form a rubber-to-rubber frictional contact between the endless belt and rollers to minimize slippage. The belt can be about 45" wide and form an exercising surface about 58" long. The pans 30 can be formed of 14 gauge steel which is sufficient for supporting both the support rails 38 and the shafts 28.

A sprocketed end piece (not shown) having a plurality of teeth spaced about its circumference to coincide with the periodic spacing of springs 40 about endless belt 10 can be mounted with the shaft 28. Such sprocket thus engages the springs 40 much like a chain and sprocket. This sprocket is helpful to ensure that the second embodiment of roller assembly 43 and endless belt 10 move as one unit without the binding of roller assembly 43 on support rails 38.

Shown best in FIG. 5, when an exerciser is on the support surface 10, the roller assemblies 43 tend to orient themselves rotationally relative to the support rails 38 for accomodating the weight of the exerciser so that there is little if any relative sliding between the hook portions of the springs 40 and the grommets 42 or brackets 44. The springs 40 are tensioned so that there is enough give or resiliency in the support surface 10 to alleviate the pounding effect which a runner experiences on a hard surface yet not enough spring to provide an unacceptable bounce. A pleasant sensation is provided where most of the impact on the exerciser's legs for each step is absorbed.

Appropriate leveling casters 50 are connected at each corner of the machine, the ones on the front of the machine being connected to powered jack-screws (not shown) or the like which are controlled by a push button or dial (not shown) on the control panel 20 for selectively raising and lowering the front end of the support surface 10 so that it can be used as a flat surface or at an incline up to about 20–25 degrees.

It can be seen that the novel treadmill has a relatively simple construction which provides a trampoline-like support surface that removes a substantial amount of the strain on a person who is walking, jogging or running on the surface. The exercising surface can be powered solely by the individual who is exercising or by a motor moving the surface in a range from about 3–15 miles per hour. The surface can remain flat or be inclined up to about 20–25 degrees.

Hand operated controls can be provided on a control panel or on guard rails located around the exercising surface which are easily within the reach of the individual. An emergency control which can be gripped by an individual to power the treadmill can be provided which, when released, automatically turns off the motor which moves the belt. The treadmill as described is especially advantageous for people who are undergoing a rehabilitation program because of the shock and impact absorption qualities of the exercising surface.

The foregoing disclosure and description of the invention are intended to be illustrative and explanatory and various changes in the size, shape and materials as well as in the details of the illustrated construction may be made without departing from the spirit of the invention. All such changes are contemplated as falling within the scope of the appended claims.

We claim:

1. A treadmill, comprising:

(a) an endless belt, the uppermost surface of which is adapted to form a flat exercising surface;

(b) first support means located within the endless belt at each end of the exercising surface for supporting and allowing the endless belt to be moved longitudinally;

(c) second endless support means spaced from and extending substantially along respective sides of the endless belt;

(d) a plurality of connecting means for connecting the edges of the endless belt to their respective second endless support means for continuously supporting the edges as the endless belt moves relative to the second endless support means; and (e) said plurality of connecting means each including a spring means between an edge and the connection to said second support means, for providing trampoline-like resiliency to the support surface.

2. The treadmill of claim 1, wherein the first support means includes a pair of rotatable rollers.

3. The treadmill of claim 2, and further including means for rotating one of the rollers, the belt being driven through frictional contact between the inner surface of the belt and the rotated roller.

4. The treadmill of claim 3, and further including a frame, each roller including a shaft for connecting the rollers to the frame.

5. The treadmill of claim 4, wherein one of the rollers is rotatable relative to its shaft and the means for rotating one of the rollers is connected to the roller rotatable relative to its shaft.

6. The treadmill of claim 4, wherein at least one of the shafts is rotatably connected to the frame and its respective roller is rotatable with the shaft and the means for rotating one of the rollers is connected to the shaft for rotating the roller rotatable with the shaft.

7. The treadmill of claim 1, and further including a frame, the second endless support means including two continuous rails each connected to the frame and extending along a respective edge of the endless belt.

8. The treadmill of claim 7, wherein the plurality of connecting means each includes a roller assembly slidably engaging the surface of its respective rail facing away from the belt, and a spring means for connecting each roller assembly to the belt.

9. The treadmill of claim 8, wherein the roller assembly comprises:

a bracket; and a first roller rotatably mounted on the bracket through a pin, the first roller is self-aligning.

10. The treadmill of claim 9, wherein the roller assembly further includes:

a second pair of rollers each rotatably mounted on the bracket through a respective pin a predetermined distance from the first roller such that said second pair of rollers slidably engage the rail on an opposite side than said first roller.

11. The treadmill of claim 10, wherein the roller assembly further includes:

a first needle bearing disposed between the first roller and its mounting pin and a second needle bearing disposed between each of the second rollers and their respective mounting pins.

12. The treadmill of claim 8, wherein the roller assembly comprises:

a housing, the housing having a central cavity a predetermined size larger than the support rail;

a bearing sleeve mounted interior of the central cavity of the housing and having a plurality of ball bearings disposed therein which slidably engage the support rail.

13. The treadmill of claim 8, wherein each spring means includes a coil spring connected between each roller assembly and the belt.

14. The treadmill of claim 7, wherein each end of the frame includes a pair of legs one on each side of the belt, pan means connected to each leg, said continuous support rails being connected to the pans on each side of the belt, each roller including a shaft connected between the pans at each end of the belt.

15. The treadmill of claim 14, wherein the legs at one end of the belt include means for raising and lowering the legs for changing the angle of the exercising surface.

16. The treadmill of claim 1, and further including a guard rail surrounding at least three sides of the exercising surface and located at a height so that the rails can easily be grasped by the exerciser.

* * * * *